US008702411B2

(12) United States Patent
Bayle et al.

(10) Patent No.: US 8,702,411 B2
(45) Date of Patent: Apr. 22, 2014

(54) PRESS TOOLING

(75) Inventors: Jean-Philippe Bayle, Villeneuve les Avignon (FR); Frédéric Jorion, Sabran (FR); Gérard Delette, Grenoble (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 33 days.

(21) Appl. No.: 13/254,061

(22) PCT Filed: Mar. 2, 2010

(86) PCT No.: PCT/EP2010/052580

§ 371 (c)(1),
(2), (4) Date: Sep. 6, 2011

(87) PCT Pub. No.: WO2010/100123

PCT Pub. Date: Sep. 10, 2010

(65) Prior Publication Data

US 2011/0311667 A1 Dec. 22, 2011

(30) Foreign Application Priority Data

Mar. 4, 2009 (FR) ..... 09 51360

(51) Int. Cl.
*B29C 43/36* (2006.01)

(52) U.S. Cl.
USPC ..... 425/78; 425/405.2; 425/412; 425/415; 425/419; 425/423

(58) Field of Classification Search
USPC ..... 425/78, 450.1, 450.2, 412, 415, 419, 425/423
See application file for complete search history.

(56) References Cited

U.S. PATENT DOCUMENTS

| | | | | |
|---|---|---|---|---|
| 2,101,015 | A | 12/1937 | Anderson | |
| 2,942,298 | A | 6/1960 | Loedding | |
| 3,734,658 | A | 5/1973 | Livera | |
| 4,666,389 | A | 5/1987 | Relis et al. | |
| 6,440,357 | B1 * | 8/2002 | Hinzmann | 425/78 |
| 7,381,046 | B2 * | 6/2008 | Kuo | 425/443 |
| 7,393,370 | B2 * | 7/2008 | Peterman et al. | 425/117 |
| 8,167,602 | B2 * | 5/2012 | Hartner | 425/193 |

FOREIGN PATENT DOCUMENTS

| | | |
|---|---|---|
| FR | 2 894 871 A1 | 6/2007 |
| JP | 2000-135598 | 5/2000 |

* cited by examiner

*Primary Examiner* — Joseph S Del Sole
*Assistant Examiner* — Thukhanh Nguyen
(74) *Attorney, Agent, or Firm* — Oblon, Spivak, McClelland, Maier & Neustadt, L.L.P.

(57) ABSTRACT

A pressing tooling machine, including one or two punches, a die including sectors that can separate from each other but are connected to a shared primary portion, and a ring surrounding and holding the sectors, against which it is adjusted by tapered surfaces, and the altitude of which varies owing to the rotation of a crown provided with a surface in relief. When compression is finished, stripping is preceded by a slight separation of the sectors, which makes it possible to release stresses in the compressed piece and avoid many risks of damaging the piece. The sectors are made resistant by inserts made from a hard material, generally removable and able to be machined to an exact profile of the pieces to the formed.

14 Claims, 5 Drawing Sheets

PRESS TOOLING

The invention relates to press tooling.

The manufacture of mechanical parts by powder pressing to yield a compact preform, followed by sintering, can involve the use of uniaxial compression machines comprising a die in a housing of which the powder is poured and a punch engaging in the housing to perform the compression of the powder or, alternatively, a pair of punches engaging by two opposite ends of the housing in two opposite directions. These presses operate at relatively high rhythms. There are many applications: they can relate to metal or ceramic mechanical pieces such as gears, magnets, fuel pellets, etc.

This type of method does, however, have drawbacks. One of the most significant appears upon stripping of the compressed piece by gradually removing it through an axial thrust movement from the housing. The compression has produced radial stresses in the piece, which are freed as it comes out of the housing. The risks of damaging the piece by cracking or breaking are frequent at the orifice of the housing, between the portions that are still stressed and the portions that are suddenly released. Another observed drawback is that the pieces that have withstood stripping often have notable variations in the radial dimension. In fact, the compression is not uniform, but on the contrary is greater close to the punch(es), and as a result the density of the piece is greater in those locations. When the sintering is done, the removal of the piece is less important as the density is larger, such that finished pieces tend to assume a slightly conical shape when a single punch has been used, or bi-conical and curved in the middle, in the shape of a bobbin, when two punches have been used. Size or shape defects can lead to a large number of pieces being discarded.

Various methods have been used to improve the quality of the pieces. These include the use of lubricant or binder additives in powders or the choice of particular compression sequences by the punches; but the additives harm the sintering because they are volatile and can cause pollution, and the latter methods slow down production rhythms considerably. These two groups of methods do, however, more or less resolve other defects, such as insufficient cohesion of the material after compression.

Other methods consist of supplying the orifice of the housing of the die with a chamfer or fillet radius to prevent the piece from undergoing an abrupt transition during stripping between the stressed state and the relaxed state, but this method is only effective with very determined orifice profiles specific to each variety of pieces, such that it is difficult to implement.

Still other methods consist of adding tubes made of rubber or other flexible materials into the die to facilitate stripping and which are then sacrificed, but this is also costly.

Lastly, another type of method, for example described in document U.S. Pat. No. 7,128,547, consists of dividing the die into sectors that are assembled during the performance of the compression and then separated so as to release the residual compression stresses all at once for the entire piece. The embodiments of such methods often do not comprise a means for holding the die sectors once it has been loosened, which makes them unsuited to automation. Others include a mechanism for controlling the movements of the sectors making it possible to automate the method, but they are complex, requiring the use of actuators for the sectors, and they do not really guarantee that the sectors are indeed attached when the powder is poured, which is necessary for good manufacturing.

The invention was designed to obviate these drawbacks and allow automatic and reliable compression of pieces at a fast rhythm while reducing the risks of damage to the pressed pieces during stripping and subsequent shape and size defects, which can often be attributed to a poor return to the original position of the die sectors that have been moved apart to favor stripping.

In a general form, the invention relates to a press tooling comprising at least one mobile punch, the tooling comprising a die in which the punch penetrates, the die being made up of sectors, a rack surrounding the die, which bears on the rack slidingly via conical surfaces, a means for moving the rack relative to the die in a direction of mobility of the punch, characterized in that the die comprises a single-unit piece to which the sectors are securely attached and the sectors comprise inserts at their inner surface. The construction of the die in sectors securely attached to a single-unit part, which can be solid and then constitute a bottom of the housing of the die in which the pieces are formed, or in the shape of a hollow cylinder able to allow a lower punch to pass, makes it possible to take advantage of the elasticity of the material of the die to allow the sectors to be moved apart under the internal pressure of the pieces once they have undergone the pressing, then to help reclose the die after stripping of the pieces. The separation of the sectors remains at a low level, just corresponding to the expansions sufficient to mitigate the internal pressure of the pieces, which greatly reduces the risks of accidental insertion of material and in particular of the powder to be pressed constituting the pieces, which would harm the reclosing of the die and the quality of subsequent manufacturing. The construction of the die in a single piece, with only dividing slots of the sectors extending over part of its height, provides a simple and robust construction.

Certain drawbacks of this construction must, however, be combatted. The most significant is the hardness defect that in general cannot be avoided with materials elastic enough to allow successive openings and reclosing of the die. The sectors are therefore provided with inserts on their inner surface, which are made from a material harder than the die itself and therefore fully withstand the pressures and frictions of the formed pieces. They also have the advantage of being able to adapt the tooling to different pieces without having to disassemble or replace the entire die, if they are removable from the sectors of the die.

One appreciated construction thus comprises a main portion of the die made from titanium and carbide steel inserts.

The inserts also lend themselves to shape or size modifications by machining, in particular if the inner surface thereof is machined with a variable taper incline over their height as a function of the shape and size defects of pieces manufactured by the press: this machining then contributes to improving the pieces during manufacturing of the series as a function of the measured size or shape deviations, without any damaging effect on the die since it will then suffice to replace the inserts.

According to another design, the die (more precisely its inserts) comprises a housing undercut from an orifice through which the mobile punch is introduced there; or a housing doubly undercut from opposing orifices through which the mobile punches are respectively inserted therein in the case of a tooling comprising two mobile punches, the die being hollowed out on either side and the support including a recess for the passage of one of the punches.

In an improved tooling, the means for moving the rack relative to the die comprises a crown on one face in relief by which the rack is placed on rollers, a means for pressing the rack against the crown, and a support for the crown and the die; and according to an additional improvement, the support comprises a circular cavity in which the crown is housed, the crown comprises a toothing protruding from the cavity, and a pinion driven by the motor is mounted on the support and meshes with the toothing. This control means makes it possible to apply a well-distributed and measured force on the rack and the die owing to the regularity of the shape of the crown, the distribution of the rollers over a circumference and the elasticity of the assembly.

The invention will now be described in reference to the figures, among which:

Figure 1:
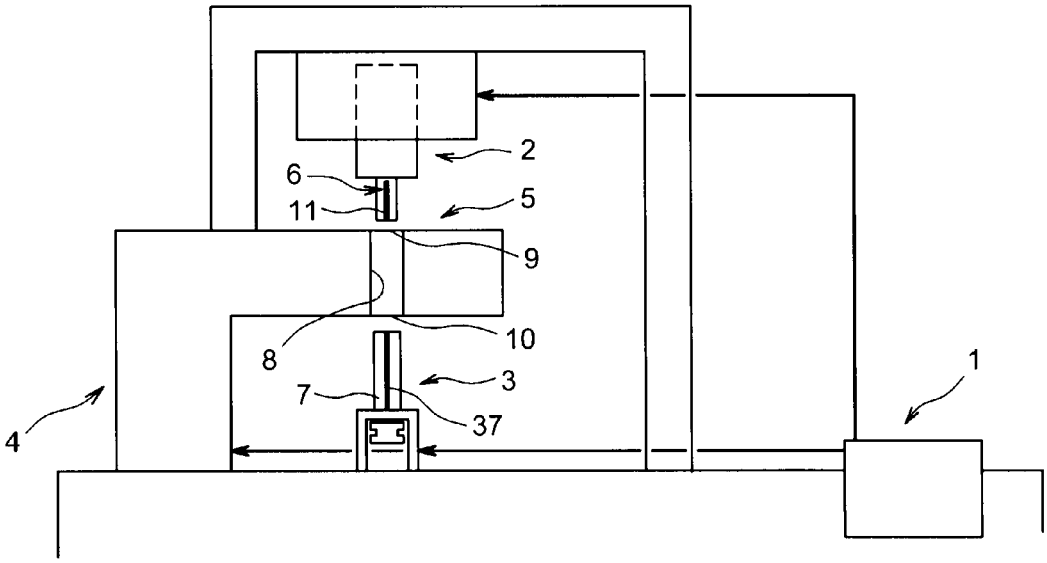
FIG. 1 is a general view of the press tooling.

FIG. 1 shows a press comprising a control system 1, an upper punch 2, a lower punch 3 and a tooling 4 specific to the invention which comprises a die 5. The upper punch 2 and the lower punch 3 comprise rods 6 and 7 oriented towards each other. The die 5 comprises a housing 8 aligned with the rods 6 and 7, which can penetrate it between opposite orifices 9 and 10. The lower piston 3 and its rod 7 comprise a needle 37 that slides there, and the rod 6 of the upper piston comprises a housing 11 across from the needle 37, which can penetrate it. This arrangement makes it possible to compress hollow pieces, with an annular shape. The invention is not limited to this situation and also relates to presses provided without needles, possibly with a single punch; the housing would then be provided with a single orifice and would comprise a bottom on the other side. The control system 1 governs the movement of the punches 2 and 3 and of the rod 6.

Figure 2:
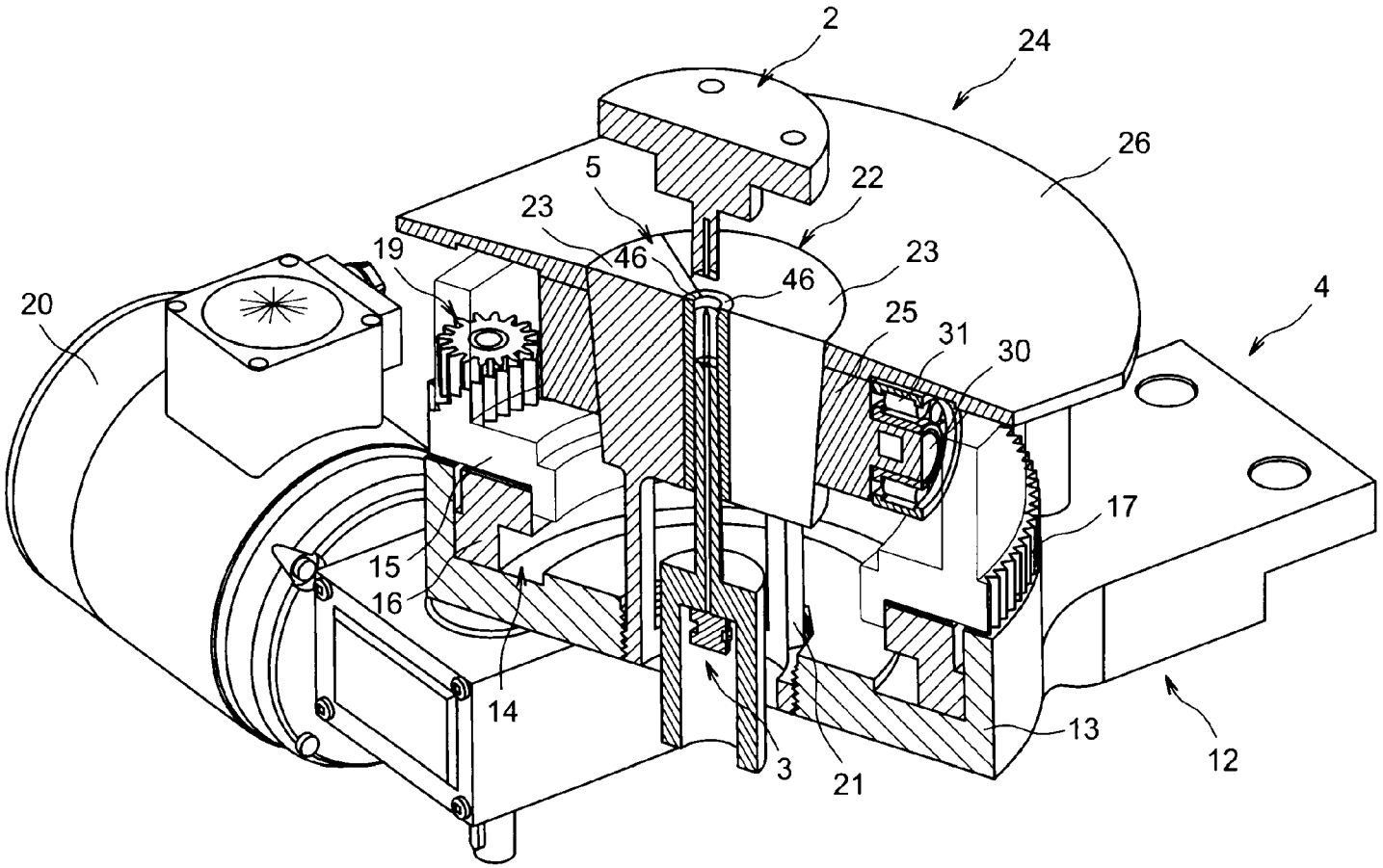
FIG. 2 is a general cross-sectional view of the tooling.
Figure 3:
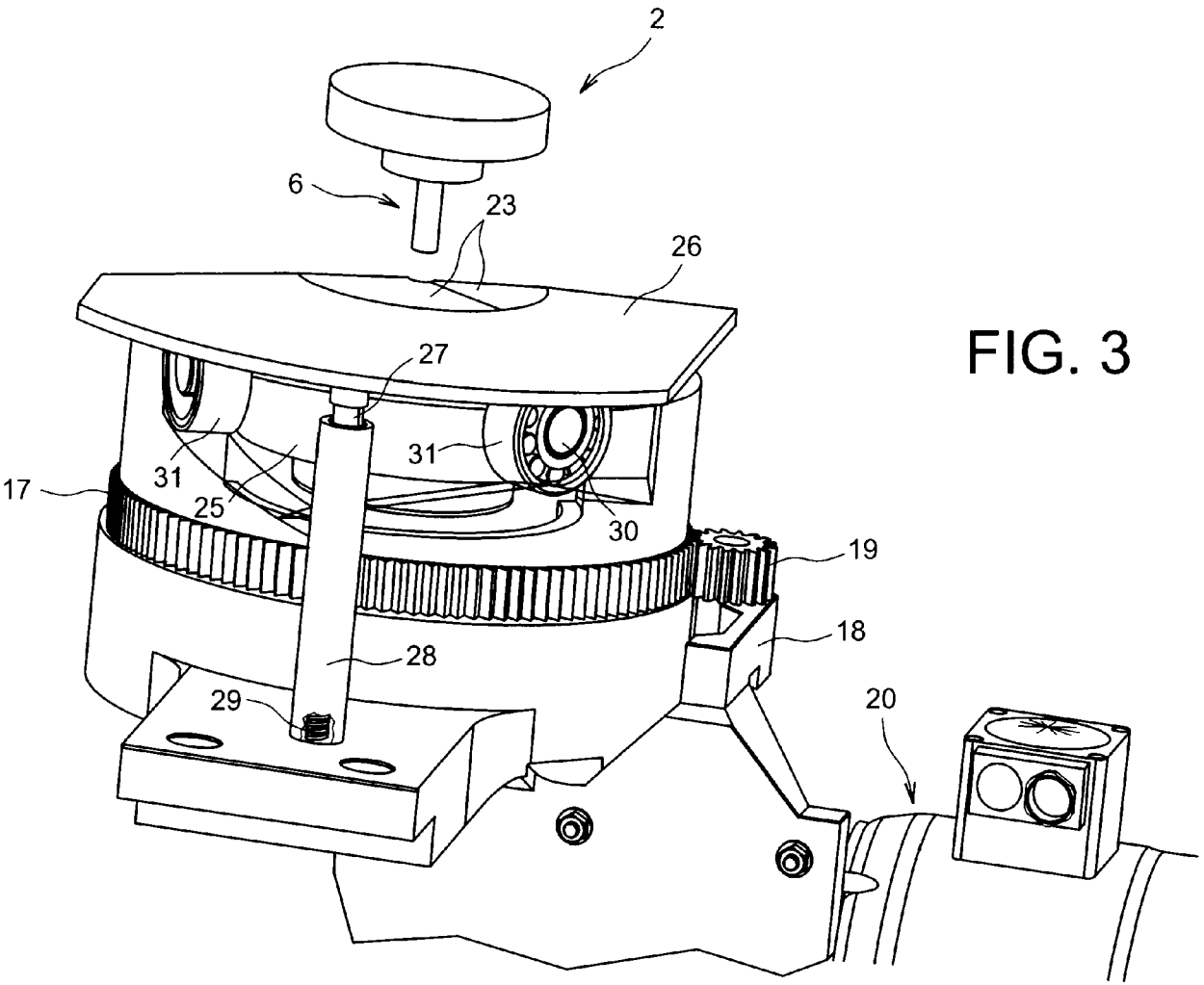
FIG. 3 is a side view of the tooling.

We will now move to the description of the tooling 4 using FIG. 2. It comprises a support 12 in the form of a plate on which a circular wall 13 rises. A cavity 14 is defined by the wall 13 and receives a crown 15. The crown 15 slides on a track 16 of the cavity 14 and can slidingly rotate around the inner face of the wall 13. The crown 15 rises above the wall 13 at the upper part thereof, where it comprises a toothing 17 protruding outward. The support 12 carries a bearing 18 (FIG. 3) for rotatably maintaining a pinion 19, and it also carries a motor 20 for driving the pinion 19.

Figure 5:
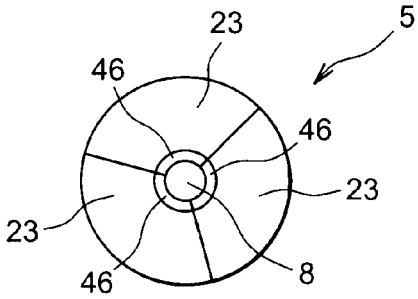
FIG. 5 is a close-up view, in diametric cross-section, of the die and the housing.

The die 5 comprises a single-unit lower part 21 in the shape of a hollow cylinder, placed on the support 12, and an upper part 22 topping the previous part, in a single piece therewith, made up of attached circle sectors 23, for example three, separated by slots but able to come into contact with each other (FIG. 5). The housing 8 fits into this upper part 22. The lower part 21 and the support 12 are hollowed out to yield passage to the lower punch 3.

A rack 24 surrounds the upper part of the die 5. It comprises a ring 25 surrounding the sectors 23 to maintain their cohesion, and a plate 26. The plate 26 bears rods 27 (two that are similar and opposite, only one being shown, in FIG. 3) pointing downwards and engaged in the bushings 28 fastened to the support 12. Springs 29 mounted in the bushings 28 attract the rods 27 downward. And the ring 25 is provided with a trio of radially oriented axes 30, each of which carries a bearing 31.

Figure 4:
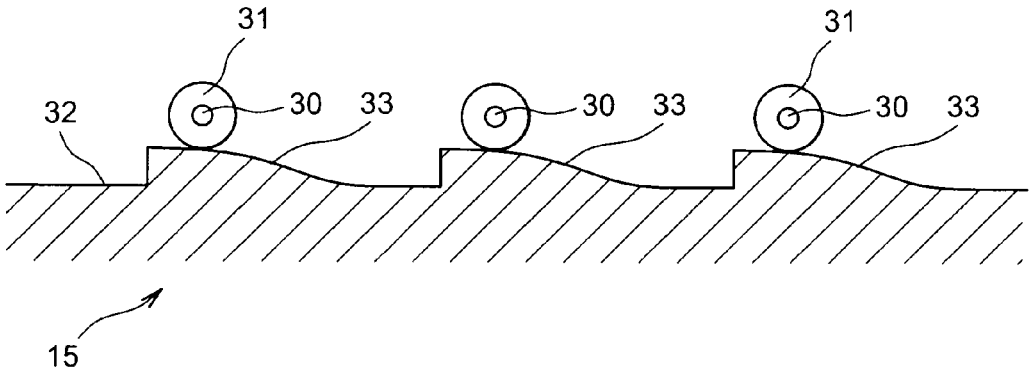
FIG. 4 is a developed view of the cam adjusting the height of the closing band of the die.
Figure 6:
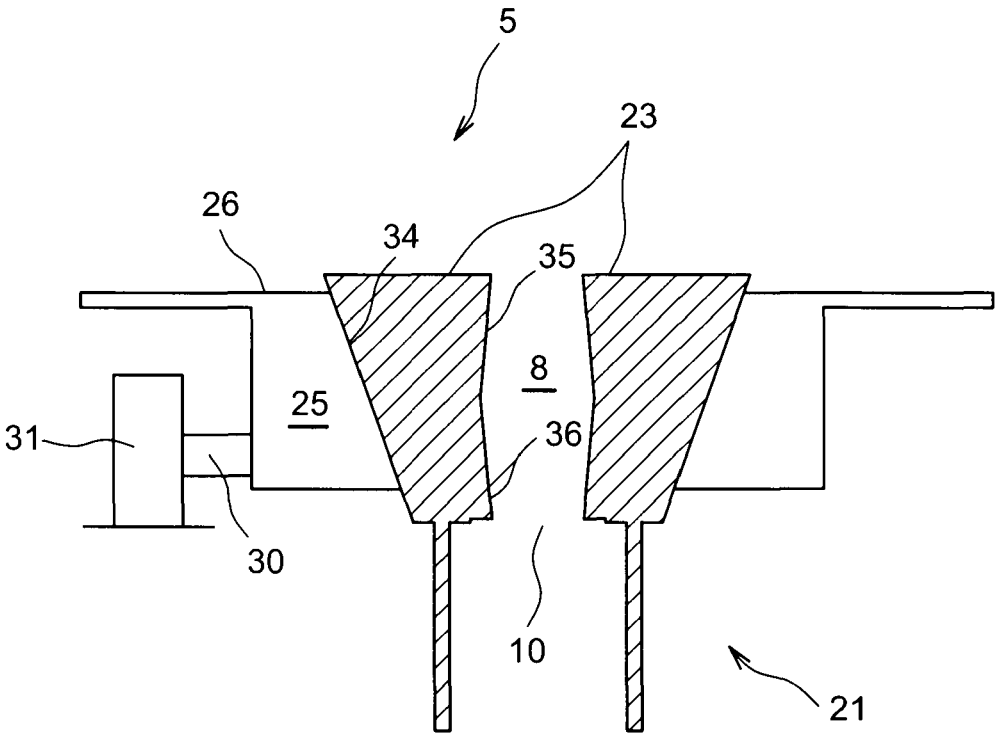
FIG. 6 is a top view of the die.

FIG. 4 shows that the bearings 31 weigh on an upper face 32 of the crown 15 that comprises three inclined cams 33, in phase with the bearings 31, respectively. When the motor 20 runs, the pinion 19 drives the crown 15 in rotation, and the cams 33 move under the bearings 31, the altitude of which varies with that of the ring 15; however, the outer surfaces of the sectors 23 and the inner surfaces of the ring 25 are inclined and form conical adjustments 34 that are shown in FIG. 6 (greatly exaggerating their incline for clarity purposes). Furthermore, the inner surfaces of the sectors 23, defining the housing 8, are also no longer cylindrical but undercut from the orifices 9 and 10, i.e. the housing 8 widens slightly from the orifices 9 and 10 to conical portions 35 and 36, respective to the center, unlike a common arrangement in this type of technique, where undercut arrangements are common to favor stripping of the piece.

The machine operates as follows. A shoe (not shown) pours powder to be compacted into the housing 8, the lower piston 3 covering the bottom. The upper piston 2 is lowered when the shoe has been removed, and the compacting of the powder follows, the lower punch 3 also being able to be set in motion. The needle 37 is also set in motion if that is provided. When the compacting is done, the upper punch 2 is raised and a rotation of the motor 20 causes the ring 25 to move and be lowered, which allows the sectors 23, remaining at the same height since they bear on the stationary part 21, to separate by sliding of the surfaces to the conical adjustments 34 and to open the die 5 until the radial compression stresses of the piece compressed in the housing 8 are released. The opening is limited to a few degrees by the elastic stress that appears at the foot of the sectors 23, at their connection to the lower part 21 to which they are secured. The die 5 can be built from titanium to have the desired elasticity. The flexure is sufficient, owing to the fineness of the lower part 21.

This tooling lends itself very well to automation, since the sectors 23 held in the ring 25 remain supported and guided by the latter and the lower part 21, without being able to fall or disperse in another way. They are positioned precisely. The device is simple and therefore reliable, even more so inasmuch as it depends on a single motor and does not use delicate transmissions. The conical adjustments 34 in practice have several degrees of incline, and the inclines of the conical portions 35 and 36 of the housing 8 are also small and simply offset the differential removals of the pieces for sintering according to the compression and density irregularities. Several percent or per-thousands are usual.

The inclines are not necessarily uniform over the height of the housing 8: they must rather be determined by the designer as a function of the results of a first series of compression and sintering tests, which will have empirically indicated the shape and size defects of the pieces and therefore the compensations to be made for the radius of the housing at each height. He then proceeds with corrective machining of the inner surfaces of the sectors 23.

Figure 7:
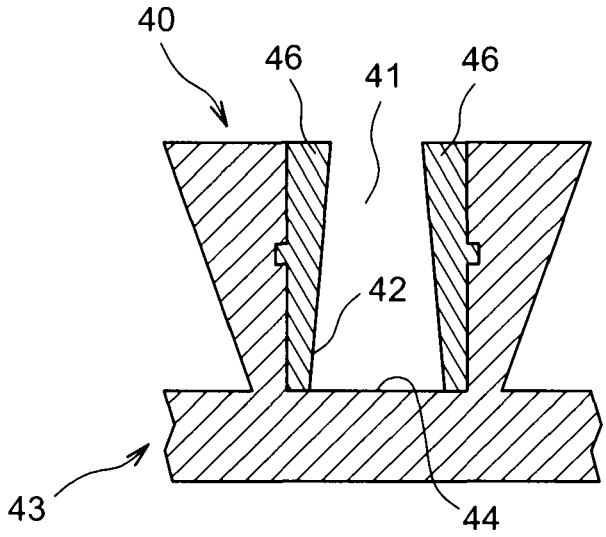
FIG. 7 is a diagrammatic view of another embodiment of the invention.

FIG. 7 shows a slightly different embodiment, where the sectors 23 are replaced by other sectors 40, here with a single taper of the inner surfaces 42, so that the housing 41 opens out toward the bottom. The lower part 43 of the die here is solid and therefore a single piece, and forms a continuous bottom 44, to which the sectors 40 are attached, for the housing 41. This arrangement is well-suited to a machine without a lower punch, where the upper punch therefore handles the compression alone.

Moreover, the sectors 23 and 40 are provided with removable inserts 46 fastened on their inner surface, which therefore undergo corrective profile machining and can be replaced without the die 5 having to be changed itself when a different piece must be made. The inserts 46 can be made from carbide steel to have great hardness and withstand the frictions and pressure produced upon pressing of the pieces, which the titanium of the die 21 or 43 cannot do. They also equip the preceding embodiment. The rest of the device is unchanged.

The invention claimed is:

1. A press tooling comprising:

at least one mobile punch;

a die in which the punch penetrates, the die including sectors separated by slots but that can come into contact with each other, the die including a single-unit piece that is connected to the sectors at a tapered side of the sectors, and the die including a connection between the sectors and the single-unit piece;

a rack surrounding the die, which bears on the rack slidingly via conical surfaces of the sectors; and a moving device to move the rack relative to the die in a direction of mobility of the punch;

wherein:

the sectors, the single-unit piece, and the connection form a single piece;

the sectors are configured to separate from each other, opening the die, and the connection between the sectors and the single-unit piece supports an elastic flexional stress; and the sectors comprise inserts at their inner surface.

2. The tooling according to claim 1, wherein the single-unit piece is a hollow cylinder thinner than the sectors.

3. The tooling according to claim 1, wherein the single-unit piece is solid.

4. The tooling according to claim 1, wherein the inserts are made from a harder material than the die.

5. The tooling according to claim 4, wherein the inserts are made from carbide steel, and the die is made from titanium.

6. The tooling according to claim 1, wherein the die comprises a housing undercut from an orifice through which the mobile punch is introduced therein.

7. The tooling according to claim 6, comprising two mobile punches, the die being hollowed out on either side and the support including a cavity for passage of one of the punches, and wherein the die comprises a housing doubly undercut from opposing orifices through which the mobile punches are respectively inserted therein.

8. The tooling according to claim 1, wherein the inserts are removable from the sectors and are replaceable.

9. The tooling according to claim 1, wherein the moving device to move the rack relative to the die comprises a crown on one face in relief by which the rack is placed on rollers, a pressing device to press the rack against the crown, a support for the crown and the die, and a motor to set the crown in rotation.

10. The tooling according to claim 9, wherein the support comprises a circular cavity in which the crown is housed, the crown comprises a toothing protruding from the cavity, and a pinion driven by the motor is mounted on the support and meshes with the toothing.

11. The tooling according to claim 1, wherein the inserts are machined on their inner surface with an incline having a variable taper over their height as a function of a shape and size defects of the pieces manufactured by the press.

12. A press tooling comprising:

at least one mobile punch;

a die in which the punch penetrates, the die including sectors separated by slots but that can come into contact with each other;

a rack surrounding the die, which bears on the rack slidingly via conical surfaces;

a moving device to move the rack relative to the die in a direction of mobility of the punch, the moving device to move the rack relative to the die comprises a crown on one face in relief by which the rack is placed on rollers, a pressing device to press the rack against the crown, a support for the crown and the die, and a motor to set the crown in rotation;

wherein:

the die comprises a single-unit piece to which the sectors are securely attached and form a single piece with it;

the sectors are configured to separate from each other, opening the die, an elastic flexional stress appearing at a connection between the sectors and the single-unit piece; and the sectors comprise inserts at their inner surface.

13. A press tooling comprising:

at least one mobile punch;

a die in which the punch penetrates, the die including sectors separated by slots but that can come into contact with each other, the die including a single-unit piece that is connected to the sectors at a tapered side of the sectors, and the die including a connection between the sectors and the single-unit piece;

a rack surrounding the die, which bears on the rack slidingly via conical surfaces of the sectors; and means for moving the rack relative to the die in a direction of mobility of the punch;

wherein:

the sectors, the single-unit piece, and the connection form a single piece;

the sectors are configured to separate from each other, opening the die, and the connection between the sectors and the single-unit piece supports an elastic flexional stress; and the sectors comprise inserts at their inner surface.

14. The tooling according to claim 13, wherein the means for moving the rack relative to the die comprises a crown on one face in relief by which the rack is placed on rollers, means for pressing the rack against the crown, a support for the crown and the die, and a motor for setting the crown in rotation.

* * * * *